US005176327A

United States Patent [19]

Petersen et al.

[11] Patent Number: 5,176,327

[45] Date of Patent: Jan. 5, 1993

[54] TRIGGER OPERATED SPRAY GUN

[75] Inventors: Eric Petersen, Winfield; Gary Paulsen, Geneva, both of Ill.

[73] Assignee: Spraying Systems Co., Wheaton, Ill.

[21] Appl. No.: 764,973

[22] Filed: Sep. 23, 1991

Related U.S. Application Data

[63] Continuation of Ser. No. 541,058, Jun. 20, 1990, abandoned.

[51] Int. Cl.[5] ..... B05B 9/01

[52] U.S. Cl. ..... 239/526; 239/525

[58] Field of Search ..... 239/525, 526

[56] References Cited

U.S. PATENT DOCUMENTS

| | | | |
|---|---|---|---|
| 2,998,924 | 9/1961 | Schaeffer . | |
| 3,599,876 | 8/1971 | Kyburg . | |
| 3,612,406 | 10/1971 | Bess et al. . | |
| 3,711,028 | 1/1973 | Hengesbach . | |
| 3,754,709 | 8/1973 | Laatsch . | |
| 4,083,497 | 4/1978 | Rosenberger . | |
| 4,651,929 | 3/1987 | Kranzle . | |
| 4,709,859 | 12/1987 | Schulze et al. | 239/525 |
| 4,776,517 | 10/1988 | Heren . | |
| 4,880,166 | 11/1989 | Suttner | 239/526 |

FOREIGN PATENT DOCUMENTS

| | | | |
|---|---|---|---|
| 261320 | 3/1988 | European Pat. Off. | 239/526 |
| 2345504 | 3/1975 | Fed. Rep. of Germany . | |
| 3110881A1 | 11/1982 | Fed. Rep. of Germany . | |
| 3300290 | 7/1984 | Fed. Rep. of Germany | 239/526 |
| 3303583 | 8/1984 | Fed. Rep. of Germany . | |
| 3431800A1 | 3/1986 | Fed. Rep. of Germany . | |
| 644050 | 11/1927 | France . | |
| 150008 | 8/1981 | German Democratic Rep. . | |

*Primary Examiner*—Andres Kashnikow
*Assistant Examiner*—Lesley D. Morris
*Attorney, Agent, or Firm*—Leydig, Voit & Mayer

[57] ABSTRACT

A spray gun for dispersing pressurized liquids having a barrel portion and a handle portion, a relatively simple and compactly designed control valve in the lower end of the handle portion, and a trigger pivotably mounted and adjacent the lower end of the handle portion and extending upwardly therefrom for movement between control valve actuating and deactuating positions. The control valve has a valve body formed with three mutually perpendicular passageways and contains a valve member having a valve stem extending outwardly in generally perpendicular relation to the handle for engagement by the lower end portion of the trigger. A simple transversely moveable locking element is provided for securing the trigger in a deactuated position.

20 Claims, 2 Drawing Sheets

FIG. 3.
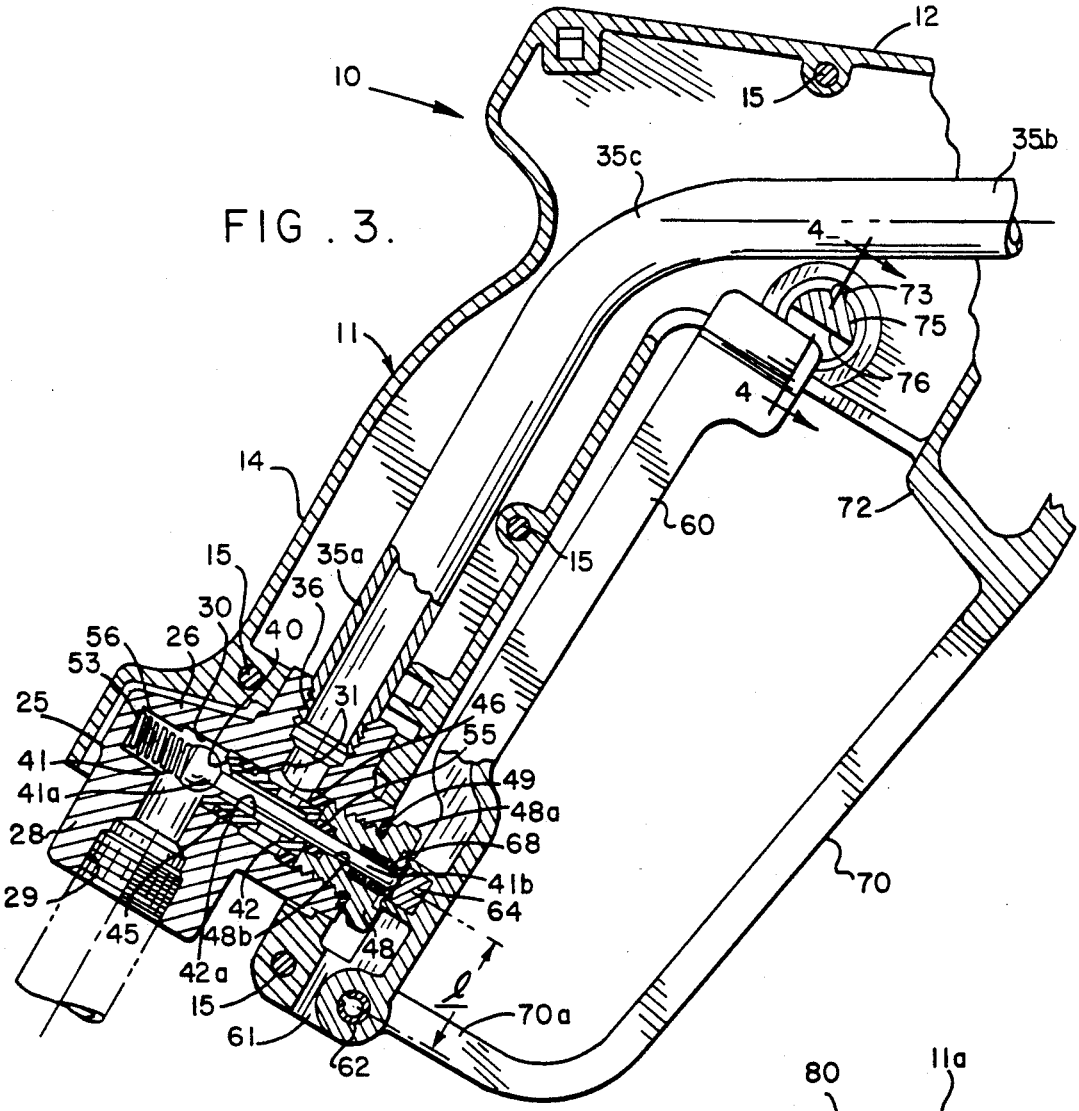
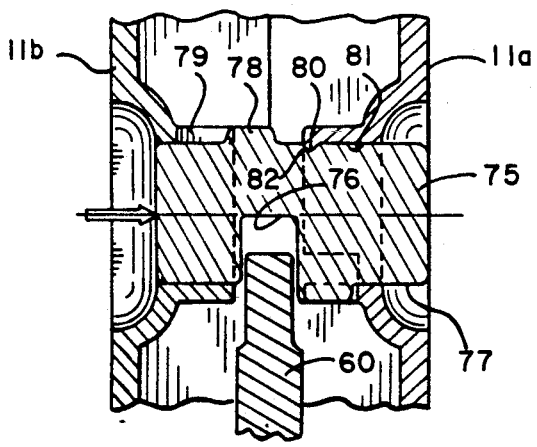
FIG. 4.
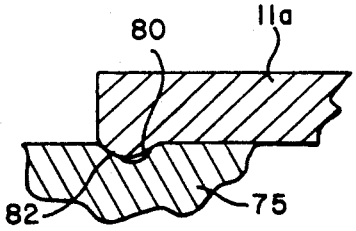
FIG. 7.

TRIGGER OPERATED SPRAY GUN

This is a continuation of copending application Ser. No. 07/541,058, filed June 20, 1990, now abandoned.

FIELD OF THE INVENTION

The present invention relates generally to spray guns, and more particularly, to spray guns of the type adapted for dispersing and directing high pressure liquids.

BACKGROUND OF THE INVENTION

Hand-held spray guns have long been used for spraying liquids in various commercial operations. Such spray guns typically employ a pivotable trigger to actuate a valve assembly for controlling the discharge of liquid from the gun and must be manufactured with sufficient massiveness and durability to withstand the high pressure liquids that are dispensed, as well as the rigors of commercial and industrial usage. Moreover, because such spray guns often have a barrel portion with a depending or angled handle, the trigger operated valve mechanism frequently is relatively complex and expensive to manufacture. As a result, many such spray guns have been bulky and expensive in construction, have been cumbersome to handle and difficult to operate, and have not lent themselves to easy repair or cleaning as may be routinely necessary. Indeed, in many such spray guns, the valve assembly is located centrally within the housing of the gun, and in order to obtain access to the valve assembly, substantial disassembly of the gun is necessary. The body of the valve assembly also often must be formed with a multiplicity of bores disposed at acute angles to each other, which is costly to manufacture.

OBJECT AND SUMMARY OF THE INVENTION

It is an object of the present invention to provide an improved trigger operated spray gun that is adapted for easier and more reliable operation and performance in dispensing high pressure liquids.

Another object is to provide a spray gun as characterized above which permits easy access to the valve assembly of the spray gun for repair and/or cleaning.

A further object is to provide a spray gun of the foregoing type which has a relatively simple construction with fewer parts, and thus lends itself to relatively economical manufacture and assembly. A related object is to provide a spray gun of such type which has a relatively small and simple to manufacture valve body.

Yet another object is to provide a spray gun of the above kind which includes an improved, relatively simple locking mechanism for maintaining the trigger in an off-position during periods of non-use.

Other objects and advantages of the invention will become apparent upon reading the following detailed description and upon reference to the drawings, in which:

BRIEF DESCRIPTION OF THE DRAWINGS

FIG. 3 is a fragmentary vertical section, similar to FIG. 1, but showing the trigger in an actuating position;

FIG. 4 is an enlarged fragmentary section of the trigger locking mechanism, similar to FIG. 2, but taken in the plane of line 4—4 in FIG. 3;

FIG. 7 is an enlarged fragmentary section illustrating the locking element position-retaining detent means.

Figures 1, 2, 5, 6:
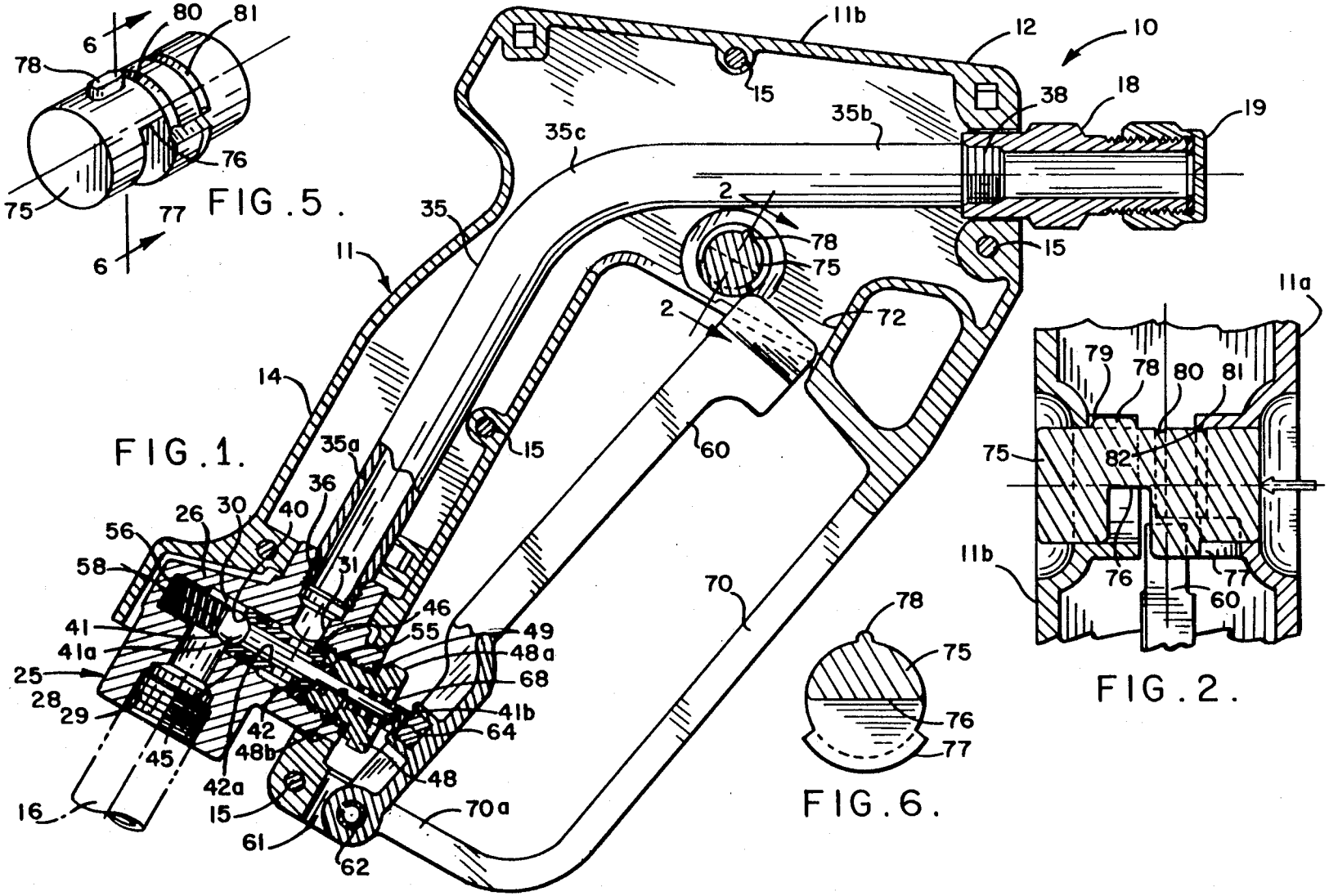
FIG. 1 is a vertical section of a spray gun embodying the present invention.
FIG. 2 is an enlarged fragmentary section of the trigger locking mechanism of the illustrated spray gun, shown in a trigger locking position, taken in the plane of line 2—2 in FIG. 1.
FIG. 5 is a perspective of the locking element of the illustrated trigger locking mechanism.
FIG. 6 is a vertical section taken in the plane of line 6—6 in FIG. 5.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring more particularly to the drawings, there is shown an illustrative hand held spray gun 10 embodying the present invention. The illustrated spray gun 10 has a pistol configured outer housing 11 having a barrel portion 12 and a depending handle portion 14 disposed at an obtuse angle of about 120° to the barrel portion 12. The housing 11 in this case is formed by right and left-hand housing sections 11*a*, 11*b*, each preferably molded of a fiberglass reinforced polypropelene, which are secured together by a plurality of fastening screws 15. A liquid supply line 16 is connected to the lower or heel end of the handle portion 14 for supplying pressurized liquid to the gun 10, and the outer end of the barrel portion 12 supports an outlet adapter 18 to which an appropriate nozzle cap 19 may be connected for effecting the desired discharging spray pattern. The outlet adapter 18 in this instance has an externally threaded outer end onto which the nozzle cap 19 is screwed.

In accordance with an important feature of the invention, the spray gun has a relatively small-sized valve assembly in the heel end of the handle portion that is easily actuatable by a bottom pivoting trigger for controlling the discharge of high pressure liquids from the gun. To this end, a valve assembly 25 is supported between the housing sections 11*a*, 11*b* at the heel or lowermost end of the handle portion 14. The valve assembly 25 includes a body 26 having a depending portion 28 extending downwardly of the housing 11 and formed with an internally threaded inlet port 29 for threadedly receiving an externally threaded end or adapter of the liquid supply line 16. The inlet port 29 communicates with a valve chamber 30, which in turn communicates with an outlet port proof the valve body 26.

In carrying out the invention, a single curved or bent fluid passage conduit 35 is connected between the valve assembly 25 in the heel end of the handle portion 14 and the outlet adapter 18 at the discharge end of the barrel 12. The fluid passage conduit 35, which is contained entirely between the housing sections 11*a*, 11*b*, includes a first portion 35*a* extending upwardly through the handle portion 14 of the housing 11, a second portion 35*b* extending along the length of the barrel portion 12, and a curved central portion 35*c* therebetween. The conduit 35, which preferably is made of steel, has an externally threaded end 36 that is engageable with an internally threaded section of the discharge port 31 of the valve assembly body 26 and an externally threaded end 38 in threaded engagement with an internally threaded end of the outlet adapter 18.

For controlling the flow of liquid between the inlet and outlet ports of 29, 31 of the valve body 26, and thus through the curved liquid passage conduit 35 and the discharge nozzle 19, a valve seat 40 is defined in the valve chamber 30 at an upstream end thereof adjacent the inlet port 29 for receiving a valve member 41 in seating engagement therewith. The valve seat 40 in this instance is formed by the upstream end of a valve sleeve 42 mounted within the valve chamber 30. To seal the valve sleeve 41 within the valve chamber 30, "O" ring and backup ring pairs 45, 46 are provided in longitudinally spaced relation about the sleeve 41 on opposite sides of the valve body discharge port 31. For retaining the sleeve 41 within the valve chamber 30 and closing the downstream end thereof, an externally threaded retaining screw 48 is secured within an internally threaded downstream end of the valve chamber 30. A sealing gasket 49 is interposed between the outer end of the valve body 26 and an externally exposed, wrench-engageable head 48*a* of the retaining screw 48.

The valve member 41 in this instance has a two-part construction comprising a valve ball 41*a* and a separate forwardly extending valve stem 41*b* projecting through axial bores 42*a* and 48*b* in the sleeve 42 and retaining screw 48, respectively. The valve stem 41*b* has a terminal end protruding outwardly of the retaining screw 48 in generally perpendicular relation to the handle portion 14 adjacent the lower end thereof for selected actuating engagement. An "O" ring and backup ring pair 55 are provided within a counterbore in the upstream end of the retaining screw 48 for effecting a sliding seal about the valve stem 41*b*. The upstream end of the valve sleeve bore 42*a* is of greater diameter than the valve stem 41*b* for defining a fluid flow passageway about the valve stem 41*b* between the inlet and outlet ports 29, 31 of the valve body 26. The valve member 41 is biased toward a valve closing position with the ball 41*a* seated against the seat 40 by a spring 56 interposed between the upstream end of the valve member 41 and the end of an axial recess 58 formed in the valve body 26 forwardly of the valve member.

In order to move the valve member 41 between its closed position in seated engagement with the valve seat 40 and an open position that permits the communication of liquid through the inlet port 29, valve chamber 30, and outlet port 31 of the valve body 26, a trigger 60 is pivotably mounted immediately below the protruding end of the valve stem 41*b* and has an upwardly extending gripping end that is pivotable by the hand while grasping the handle portion 14 of the gun. For pivotably supporting the trigger 60, the housing sections 11*a*, 11*b* have integrally formed forwardly extending arms 61 which carry a roll pin 62 upon which the trigger is mounted. The trigger 60 in this instance carries a striker pin 64 in close, upwardly spaced proximity to the roll pin 62 for engaging the protruding end of the valve stem 41*b*. Preferably, the striker pin 64 is located a distance "1" from the trigger pivot axes which is less than one-third of the length of the trigger 60, and which in the illustrated embodiment is about one-sixth of the length of the trigger. Upon pivoting of the trigger 60 from its forwardly-extended deactuating position, as shown in FIG. 1, to a retracted actuating position, shown in FIG. 3, the striker pin 64 engages and forces the stem 41*b* in an upstream direction against the force of the biasing spring 56 and pressure acting against the upstream end so as to move the ball 41*a* in forwardly displaced relation to the valve seat 40.

It will be appreciated by one skilled in the art that by virtue of the relationship of the location of the valve stem 41*b* to the bottom pivot axis of the trigger 60, sufficient leverage can be obtained for effecting reliable actuation of the valve, even when liquids under relatively high pressure, such as 4000 psi or more, are being dispersed. Moreover, as more force is required to pull the trigger, it is instinctive for the user to attempt to grip the trigger as far from the pivot axis as possible so as to increase the mechanical advantage. In conventional top pivoting trigger operated guns, this results in the smallest, and thus weakest, fingers of the hand doing most of the work. In the spray gun of the present invention, if the hand is moved farther away from the pivot axis, the fingers applying most of the work to the trigger are the strongest.

Upon release of the trigger 60 during operation of the gun, the spring 56 and the pressure acting against the valve member 41 will urge the valve ball 41*a* into engagement with the seat 40, which will move the valve stem 41*b* and trigger 60 to the right, as viewed in FIG. 1. To facilitate return of the trigger 60 to a deactuating position disengaged from the forwardly protruding end of the valve member stem 41*b*, a spring 68 is interposed between the trigger and the lower handle portion. The biasing spring 68 is seated in a counterbore formed in the outer end of the retaining screw 48 surrounding the protruding end of the valve member stem 41*b* in interposed relation to striker pin 64 carried by the trigger 60.

For establishing a predetermined deactuated position of the trigger 60 and for protecting the trigger against accidental actuation, the housing 11 is formed with a trigger guard 70 which extends downwardly from the barrel portion 12 in forwardly spaced relation to the handle portion 14 and trigger 60 and connects with a lower end 70*a* of the handle portion. The guard 70 has a rearwardly extending, trigger locating loop 72 against which the upper end of the trigger 60 is urged by the biasing spring 68.

In keeping with the invention, a transversely movable locking element 75 is carried by in the housing 11 for releasably securing the trigger 60 in its deactuated position against the locating loop 72 of the trigger guard 70. The locking element 75 is located slightly above and to the rear of the upper end of the trigger 60 and is formed with a trigger passage slot 76 The locking element 75 is selectively positioned between a trigger locking position (FIGS. 1 and 2) in which the slot 76 is laterally offset from the upper end of the trigger 60 such that the locking element 75 blocks movement of the trigger in an actuating direction, and a trigger releasing or unlocked position (FIGS.. 3 and 4) wherein the slot 76 is aligned with the end of trigger 60 for enabling movement of the trigger in a deactuating direction past the locking element 75. For guiding movement of the locking element 75 into and out of its locked position and for preventing rotational movement of the locking element and disorientation of the trigger passage slot 76 while the locked position, the locking element 75 is formed with an upstanding lug 78 that rides in a transverse slot 79 formed in the housing section 11*b*. When in the unlocked position, a depending portion 77 of the locking element 75 is retained between opposed sides of the locking element cavity defined by the housing 11 for maintaining proper alignment of the locking element. For positively locating and retaining the locking element 75 at its respective locked and unlocked positions, the locking element 75 is formed with a pair of axially spaced annular detent grooves 80, 81 which are engaged by a detent rib 82 formed in the housing section 11*a*, as shown in FIGS. 2 and 4, respectively.

From the foregoing, it can be seen that the trigger operated spray gun of the present invention is adapted for easy and reliable operation in dispensing high pressure liquids. The spray gun has relatively simple construction with fewer parts, and thus lends itself to economical manufacture and assembly. The spray gun also permits ready access to the valve assembly for repair and cleaning. In this regard, all that is necessary is disassembly of the trigger 60 by removal of the pivot pin 62, and unscrewing of the retaining screw 48 from its aperture in the upstream end of the valve body. Since the valve body 26 need only be formed with three perpendicularly oriented bores for defining the inlet port 29, outlet port and valve chamber 30, it also lends itself to simple and economical manufacture.

We claim:

1. A spray gun for dispersing pressurized liquids comprising a barrel portion having a discharge end and a handle portion depending from said barrel portion, a discharge nozzle at said barrel portion discharge end for emitting liquid from said barrel portion in a spray pattern, a trigger mounted for pivotal movement about a pivot axis adjacent a lower end of said handle portion, said trigger extending upwardly from said pivot axis in forwardly spaced relation to said handle portion for selected hand actuating movement while holding said handle portion between a forward deactuating position and a rearward actuating position, a control valve disposed in a lower end of said handle portion, said control valve including a valve body mounted in said handle portion, said valve body having a liquid inlet port for connection to a liquid supply, a valve chamber, and a liquid outlet port, means defining a liquid passage communicating between said valve body liquid outlet port and said barrel discharge end and said discharge nozzle, said inlet and outlet ports both being formed in perpendicular relation to said valve chamber in laterally offset relation to each other, and a valve stem mounted in said valve chamber for movement relative to said valve body, said valve stem having a portion extending outwardly and forwardly of said handle in generally perpendicular relation to said trigger at a location above said pivot axis for engagement by said trigger to selectively actuate said control valve in response to movement of said trigger from said forward position to said rearward position.

2. The spray gun of claim 1 including a single continuous and uninterrupted fluid passage conduit connecting between said valve body outlet port and the discharge end of said barrel portion.

3. The spray gun of claim 2 in which said fluid passage conduit includes a substantially straight section connected to said valve body discharge port and extending within said handle portion, a substantially straight section extending within said barrel portion and communicating with said discharge nozzle, and a curved intermediate portion connecting said straight sections.

4. The spray gun of claim 3 in which said barrel and handle portions are formed by a common housing.

5. The spray gun of claim 4 in which said housing is formed by a pair of housing sections.

6. The spray gun of claim 5 in which said conduit is contained entirely within said housing sections.

7. The spray gun of claim 1 in which said control valve includes a valve seat, said valve stem being mounted for movement between a position in engagement with said valve seat blocking communication of liquid from said inlet port to said discharge nozzle and an open position permitting communication of liquid from said inlet, through said control valve, and to said discharge nozzle.

8. The spray gun of claim 1 including a trigger guard extending between said barrel portion and said handle portion in forwardly spaced relation for preventing accidental engagement of said trigger.

9. The spray gun of claim 8 including locating means on said trigger guide adjacent an upper end of said trigger for locating said trigger in a predetermined deactuating position.

10. The spray gun of claim 9 including biasing mean for urging said trigger toward said deactuating position against said locating means.

11. A spray gun for dispersing pressurized liquids comprising a housing having a barrel portion and a handle portion depending from said barrel portion, said handle portion having a liquid inlet for connection to a liquid supply and said barrel portion having a discharge end, a discharge nozzle at said barrel portion discharge end for emitting liquid from said barrel portion in a spray pattern, a trigger pivotably mounted adjacent a lower end of said handle portion extending upwardly in forwardly spaced relation thereto for selected hand actuating movement while holding said handle portion between a forward deactuating position and a rearward actuating position, a control valve disposed in said handle portion and being selectively actuatable in response to movement of said trigger from said forward position to said rearward position, a locking element mounted within said housing adjacent an upper end of said trigger for transverse movement with respect to said housing between a first position which prevents pivotable movement of said trigger from said deactuating position to said actuating position and a second position which permits pivotable movement of said trigger from said deactuating to said actuating position, and said locking element having a slot which upon positioning of said locking element to said first position is in transversely offset relation to said trigger such that said locking element physically blocks movement of said trigger from said deactuating position to said actuating position, and upon movement of said locking element to said second position said slot is in alignment with said trigger so as to permit movement of the upper end of said trigger through said slot upon movement of said trigger from said deactuating position to said actuating position.

12. The spray gun of claim 11 in which said locking element and housing have cooperating means for guiding transverse movement of said locking element with respect to said housing while preventing relative rotation of movement of said locking element.

13. The spray gun of claim 12 in which said housing and locking element have cooperating first and second detent means for positively, but releasably, locating and retaining said locking element in said first and second positions, respectively.

14. The spray gun of claim 12 in which said locking element guiding means includes a lug formed on the outer periphery of said locking element and a guide slot formed in said housing for receiving and guiding movement of said lug during selected transverse positioning of said locking element relative to the housing.

15. The spray gun of claim 13 in which said detent means includes first and second laterally spaced detent recesses formed on the outer periphery of said locking element, and a detent rib on said housing for engaging said first and second detent recesses upon positioning of said locking element to said first and second positions, respectively.

16. A spray gun for dispersing pressurized liquids comprising a barrel portion and a handle portion depending from said barrel portion, said handle portion having a liquid inlet for connection to a liquid supply and said barrel portion having a discharge end, a discharge nozzle at said barrel portion discharge end for emitting liquid from said barrel portion in a spray pattern, a trigger pivotably mounted adjacent a lower end of said handle portion extending upwardly in forwardly spaced relation thereto for selected hand actuating movement while holding said handle portion between a forward deactuating position and a rearward actuating position, a control valve disposed in a lower end of said handle portion and being selectively actuatable in response to movement of said trigger from said forward position to said rearward position, and a locking element mounted adjacent an upper end of said trigger for transverse movement with respect to said trigger between a first position which prevents pivotable movement of said trigger from said deactuating position to said actuating position and a second position which permits pivotable movement of said trigger from said deactuating to said actuating position.

17. The spray gun of claim 16 in which said locking element is formed with a slot which upon positioning of said locking element to said first position is in transversely offset relation to said trigger such that said locking element physically blocks movement of said trigger from said deactuating position to said actuating position, and upon movement of said locking element to said second position said slot is in alignment with said trigger so as to permit movement of the upper end of said trigger through said slot.

18. A spray gun for dispersing pressurized liquids comprising a barrel portion having a discharge end and a handle portion depending from said barrel portion, a discharge nozzle at said barrel portion discharge end for emitting liquid from said barrel portion in a spray pattern, a trigger mounted for pivotal movement about a pivot axis adjacent a lower end of said handle portion, said trigger extending upwardly from said pivot axis in forwardly spaced relation to said handle portion for selected hand actuating movement while holding said handle portion between a forward deactuating position and a rearward actuating position, a control valve disposed in a lower end of said handle portion, said control valve including a valve body mounted in said handle portion, said valve body having a liquid inlet for connection to a liquid supply, a valve chamber. and a liquid outlet, means defining a liquid passage communicating between said valve body liquid outlet and said barrel discharge end and said discharge nozzle, a valve stem mounted in said valve chamber for movement relative to said valve body, said valve stem having a portion extending outwardly and forwardly of said handle in generally perpendicular relation to said trigger at a location above said pivot axis for engagement by said trigger to selectively actuate said control valve in response to movement of said trigger from said forward position to said rearward position, and said trigger being engageable with said valve steam at a point of engagement spaced upwardly from the pivotal axis of said trigger a distance of about one-sixth of the length of said trigger.

19. The spray gun of claim 18 in which said control valve includes a valve seat, said valve stem being movable between a position in engagement with said valve seat blocking communication of liquid from said inlet port to said discharge nozzle and an open position permitting communication of liquid from said inlet port, through said control valve, and to said discharge nozzle.

20. The spray gun of claim 18 including a single continuous and uninterrupted fluid passage conduit connecting between said valve body outlet port and said discharge nozzle.

* * * * *